US010967425B2

(12) United States Patent
Odagaki et al.

(10) Patent No.: US 10,967,425 B2
(45) Date of Patent: Apr. 6, 2021

(54) CONTINUOUS STEEL CASTING METHOD

(71) Applicant: JFE Steel Corporation, Tokyo (JP)

(72) Inventors: Tomoya Odagaki, Tokyo (JP); Norichika Aramaki, Tokyo (JP); Yuji Miki, Tokyo (JP); Naoki Kikuchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/497,183

(22) PCT Filed: Mar. 29, 2017

(86) PCT No.: PCT/JP2017/013065
§ 371 (c)(1),
(2) Date: Sep. 24, 2019

(87) PCT Pub. No.: WO2018/179181
PCT Pub. Date: Oct. 4, 2018

(65) Prior Publication Data

US 2020/0016651 A1 Jan. 16, 2020

(51) Int. Cl.
*B22D 11/20* (2006.01)
*B22D 27/02* (2006.01)

(52) U.S. Cl.
CPC ..... *B22D 11/207* (2013.01); *B22D 27/02* (2013.01)

(58) Field of Classification Search
CPC ..... B22D 11/112; B22D 11/20; B22D 11/205; B22D 11/207; B22D 27/02
USPC ..... 164/466, 467, 468, 502, 503, 504, 476, 164/417, 454, 484, 413
See application file for complete search history.

(56) References Cited

U.S. PATENT DOCUMENTS 6,241,004 B1 * 6/2001 Ebisu et al. ..... B22D 11/122 164/466

FOREIGN PATENT DOCUMENTS

| | | | |
|---|---|---|---|
| CN | 101678447 | A | 3/2010 |
| CN | 101698224 | A | 4/2010 |
| CN | 102189103 | A | 9/2011 |
| CN | 105127390 | A | 12/2015 |

(Continued)

OTHER PUBLICATIONS

International Search Report and Written Opinion for International Application No. PCT/JP2017/013065 dated May 16, 2017, 5 pages.

(Continued)

*Primary Examiner* — Kevin P Kerns
(74) *Attorney, Agent, or Firm* — RatnerPrestia

(57) ABSTRACT

A continuous steel casting method includes producing a strand. The producing of the strand includes pouring molten steel into a mold of a continuous casting machine and withdrawing a solidified shell from the mold, the solidified shell being a solidified portion of the molten steel. The method includes applying a static magnetic field to at least a portion of a region of the strand, the strand being in the continuous casting machine, the region being a region where a solid fraction fs at a thickness-wise middle position of the strand is in a given range, the static magnetic field having a magnetic field strength of greater than or equal to 0.15 T and being in a direction orthogonal to a direction in which the strand is withdrawn, the static magnetic field being applied at an application time ratio of greater than or equal to 10%.

4 Claims, 2 Drawing Sheets

(56) References Cited

FOREIGN PATENT DOCUMENTS

| | | | |
|---|---|---|---|
| CN | 105839006 | A | 8/2016 |
| EP | 0263725 | A2 | 4/1988 |
| EP | 0655288 | A1 | 5/1995 |
| EP | 2165788 | A1 | 3/2010 |
| EP | 3054460 | A1 | 8/2016 |
| JP | 57130747 | A | 8/1982 |
| JP | 6310050 | A | 1/1988 |
| JP | 01154854 | A | 6/1989 |
| JP | 02151354 | A | 6/1990 |
| JP | 0569099 | A | 3/1993 |
| JP | 06126405 | A | 5/1994 |
| JP | 07100608 | A | 4/1995 |
| JP | 09295113 | A | 11/1997 |
| JP | 2008221278 | A | 9/2008 |
| JP | 2009195937 | A | 9/2009 |
| JP | 2010179342 | A | 8/2010 |
| JP | 2010274299 | A | 12/2010 |
| JP | 2014073503 | A | 4/2014 |
| JP | 2017074603 | A | 4/2017 |
| KR | 20040057214 | A | 7/2004 |
| TW | 252056 | B | 7/1995 |

OTHER PUBLICATIONS

Taiwanese Office Action with Search Report for Taiwanese Application No. 107102613, dated Sep. 20, 2018, 4 pages.

Extended European Search Report for European Application No. 17 903 688.4, dated Feb. 28, 2020, 6 pages.

Korean Office Action for Korean Application No. 10-2019-7027777, dated Nov. 18, 2020 with Concise Statement of Relevance of Office Action, 5 pages.

Chinese Office Action for Chinese Application No. 201780089172.2, dated Dec. 3, 2020 with Concise Statement of Relevance of Office Action, 12 pages.

* cited by examiner

CONTINUOUS STEEL CASTING METHOD

CROSS REFERENCE TO RELATED APPLICATIONS

This is the U.S. National Phase application of PCT/JP2017/013065, filed Mar. 29, 2017, the disclosure of this application being incorporated herein by reference in its entirety for all purposes.

FIELD OF THE INVENTION

The present invention relates to a continuous steel casting method that is effective for reducing centerline segregation present in strands produced by continuous casting.

BACKGROUND OF THE INVENTION

In continuous casting of steel, in the process in which the molten steel poured into a mold solidifies, solute elements, such as carbon (C), phosphorus (P), sulfur (S), and manganese (Mn), are driven away from the solidified shell-side toward the unsolidified layer-side. The solidified shell is the solid phase, and the unsolidified layer is the liquid phase. Such solute elements are concentrated in the unsolidified layer, which results in so-called segregation. The degree of the segregation is greatest at or near a thickness-wise middle position of the strand. The thickness-wise middle position corresponds to the final solidification portion.

Furthermore, in the process of solidification, molten steel shrinks in volume on the order of several percent. This shrinkage in volume results in formation of negative-pressure voids in the solid-liquid coexisting zone of a solidification-final-stage portion of the strand, which is a zone that contains a large number of equiaxed crystals. As a result, the solute-element-concentrated portion of the molten steel (hereinafter also referred to as "enriched molten steel") passes through narrow passages of the solid-liquid coexisting zone and is sucked into the negative-pressure voids, which results in the occurrence of centerline segregation in a thickness-wise middle portion of the strand. On the other hand, in the case where the solute-element-concentrated portion of the molten steel is not sucked, voids referred to as "porosities" are formed in the thickness-wise middle portion of the strand.

Centerline segregation and porosities have an adverse effect on the quality of steel products. Accordingly, to reduce the adverse effect, various technologies have been proposed and are being implemented.

For example, Patent Literature 1 discloses the following technology. The degree of superheat of molten steel in a tundish is adjusted to be lower than or equal to 50° C., and the molten steel is then poured into a continuous casting mold. An electromagnetic force is exerted on the unsolidified layer of the strand to cause agitation so that the solidified structure of the thickness-wise middle portion of the strand can be a fine equiaxed crystal structure. In addition, at a point in time when the solid fraction at a thickness-wise middle position of the strand is 0.1 to 0.8, the strand, which includes the unsolidified layer, is subjected to soft reduction in a range of 5 mm to 50 mm to compensate for the solidification shrinkage. In this manner, the flow of enriched molten steel in the final stage of solidification is inhibited.

Patent Literature 2 discloses the following technology. Molten steel having a degree of superheat adjusted to be 20 to 40° C. is poured into a continuous casting mold. In addition, at a lower portion of the mold, a static magnetic field is applied to control the flow of the molten steel so that the solidified structure can be a columnar-crystallized structure, and the solidification interface can, therefore, be uniform. Further, in the final stage of solidification, the strand is subjected to soft reduction. In this manner, centerline segregation in the strand is mitigated.

Patent Literature 3 discloses the following. The degree of superheat of molten steel is set to be 50 to 80° C. so that the solidified structure of the strand can be a columnar crystal structure, and, in a region where the solid ratio is 30 to 75% in a transverse cross section of the strand, a static magnetic field is applied to the strand. In this manner, centerline segregation in the strand is mitigated.

PATENT LITERATURE

PTL 1: Japanese Unexamined Patent Application Publication No. 6-126405

PTL 2: Japanese Unexamined Patent Application Publication No. 7-100608

PTL 3: Japanese Unexamined Patent Application Publication No. 2008-221278

SUMMARY OF THE INVENTION

Unfortunately, the technologies of the related art described above pose the following problems.

Specifically, the technology of utilizing, in combination, agitation caused by an electromagnetic force and soft reduction, as disclosed in Patent Literature 1, is a technology for reducing the flow of enriched molten steel to the thickness-wise middle portion of the strand and reducing the accumulation of the enriched molten steel therein. This is achieved by causing agitation by using electromagnetic force, thereby ensuring that the solidified structure of the thickness-wise middle portion of the strand is a fine equiaxed crystal structure and the flow resistance of the thickness-wise middle portion of the strand is increased. In addition, the technology is a technology for inhibiting the flow of enriched molten steel by performing soft reduction in the final stage of solidification to compensate for the solidification shrinkage, thereby reducing the flow driving force of the enriched molten steel. Accordingly, a high centerline segregation reducing effect can be expected. To meet the rigorous demands for quality, however, the technology disclosed in Patent Literature 1 is insufficient. It is necessary to further mitigate the centerline segregation that occurs within the equiaxed crystal structure of the strand.

In the technology disclosed in Patent Literature 2, the solidified structure is controlled by an electromagnetic force. However, the portion of the strand to which a magnetic field is applied is positioned at a lower portion of the mold. Application of a magnetic field at this portion has no effect for the final stage of solidification, which has an influence on centerline segregation. As a result, the solidified structure in the thickness-wise middle portion of the strand cannot be a columnar-crystallized structure.

Furthermore, in the technology disclosed in Patent Literature 3, the degree of superheat of molten steel is set to be 50 to 80° C., and as a result, the solidified structure can be a fully columnar-crystallized structure. In the technology, however, the degree of superheat of molten steel is set to be higher than or equal to 50° C., and as a result, the probability of a breakout due to an insufficient thickness of the solidified shell significantly increases. To address this, it is necessary to reduce the strand withdrawal speed, and therefore productivity deteriorates.

Aspects of the present invention are directed toward solving these problems of the related art, and an object according to aspects of the present invention is to propose a continuous steel casting method that makes it possible to produce a strand in which centerline segregation is negligible and which, therefore, can meet the recent rigorous demands for the quality of steel products.

A summary of aspects of the present invention, which is provided to solve the problems described above, is as follows.

[1] A continuous steel casting method, the method including producing a strand, the producing of the strand including pouring molten steel into a mold of a continuous casting machine and withdrawing a solidified shell from the mold, the solidified shell being a solidified portion of the molten steel, the method including applying a static magnetic field to at least a portion of a region of the strand, the strand being in the continuous casting machine, the region being a region where a solid fraction fs at a thickness-wise middle position of the strand is in a range of formula (1) below, the static magnetic field having a magnetic field strength of greater than or equal to 0.15 T and being in a direction orthogonal to a direction in which the strand is withdrawn, the static magnetic field being applied at an application time ratio of greater than or equal to 10%, the application time ratio being defined by formula (2) below.

[Math. 1]

$$0 < fs \leq 0.3 \quad (1)$$

$$\text{Application time ratio (\%)} = \frac{\left(\begin{array}{c}\text{Time period during which static magnetic field is}\\ \text{applied to strand (min)}\end{array}\right)}{\left(\begin{array}{c}\text{Time period from time at which solid fraction}\\ \text{at thickness-wise middle position of strand}\\ \text{exceeds 0 to time at which solid fraction}\\ \text{reaches 0.3 (min)}\end{array}\right)} \times 100 \quad (2)$$

[2] The continuous steel casting method according to [1], wherein, in a region where the solid fraction at the thickness-wise middle position of the strand is 0.3, a value determined by formula (3) below is greater than or equal to 0.27° C.×min$^{1/2}$/mm$^{3/2}$.

[Math. 2]

$$\frac{G}{\sqrt{V}} \quad (3)$$

In formula (3), G is a temperature gradient (° C./mm) at a position where a solid fraction of the strand is 0.99 in a region where the solid fraction at the thickness-wise middle position is 0.3, and V is a speed (mm/min) at which a solid-liquid interface of the strand moves.

[3] The continuous steel casting method according to [1] or [2], further including performing reduction rolling on a region of the strand, the region being a region where the solid fraction at the thickness-wise middle position of the strand ranges from 0.3 to 0.7, the reduction rolling being performed by using a plurality of pairs of strand support rolls disposed such that a spacing between rolls is gradually reduced toward a downstream end with respect to a casting direction, the reduction rolling being performed at a reduction ratio of less than or equal to 5.0%.

In accordance with aspects of the present invention, a static magnetic field is applied to a region of a strand, the region being a region where the solid fraction at a thickness-wise middle position of the strand is in a range of greater than 0 and 0.3 or less, the static magnetic field being applied in a direction orthogonal to the strand withdrawal direction at a predetermined strength for a predetermined length of time. Accordingly, thermal convection in the unsolidified layer within the strand is inhibited, which increases the temperature gradient of the unsolidified layer in a thickness direction of the strand. Consequently, the solidified structure of the thickness-wise middle portion of the strand is a columnar crystal structure. As a result, the solidification interface is uniform, and an average segregation spot diameter of the solidified structure of the strand is reduced. Hence, the following is achieved: a strand that is cast using a continuous casting machine has reduced centerline segregation of solute elements, such as carbon, phosphorus, sulfur, and manganese.

DETAILED DESCRIPTION OF EMBODIMENTS OF THE INVENTION

An embodiment of the present invention will now be described.

Figure 1:
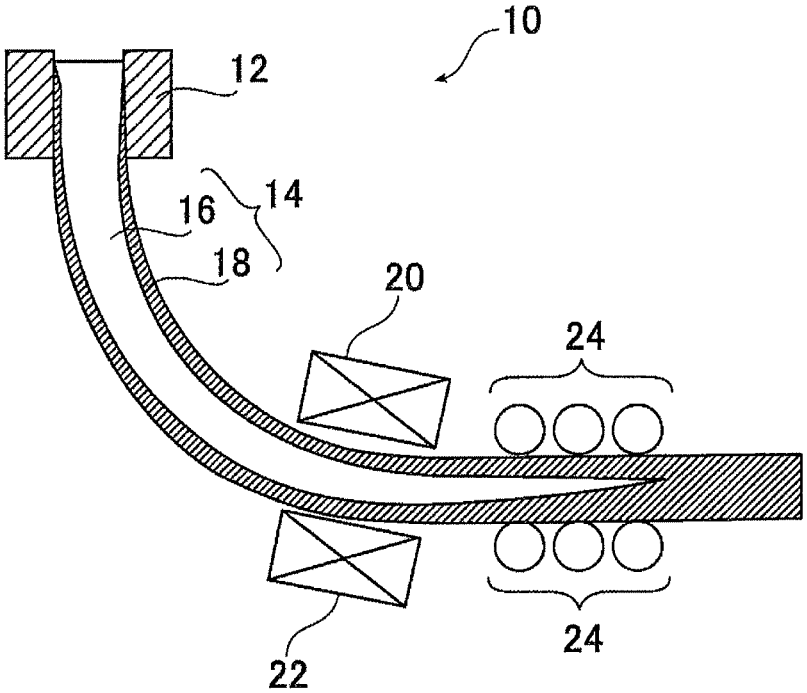
FIG. 1 is a schematic cross-sectional view of an example of a continuous casting machine, in which a continuous casting method according to an embodiment of the present invention can be used.

FIG. 1 is a schematic cross-sectional view of an example of a continuous casting machine 10, in which a continuous casting method according to an embodiment of the present invention can be used. In FIG. 1, reference numeral 12 denotes a mold; 14, a strand; 16, an unsolidified layer (unsolidified portion of molten steel); 18, solidified shell; and 20 and 22, static magnetic field generation devices that are installed in a manner such that the strand 14 can be positioned therebetween. In the strand 14, the outer shell is the solidified shell 18, and the inner portion is the unsolidified layer 16. After solidification at a thickness-wise middle position is completed, the strand 14 is entirely formed of the solidified shell 18, and the unsolidified layer 16 is no longer present.

The continuous casting machine 10 includes a plurality of segments (not illustrated). Each of the segments includes a plurality of pairs of strand support rolls that face each other in a manner such that the strand 14 can be positioned therebetween. After being withdrawn from the mold 12, the strand 14 is withdrawn downwardly in the casting direction while the strand is supported by the strand support rolls disposed in the segments. In a segment near the position where the solidification of the strand 14 is to be completed, a plurality of pairs of strand support rolls 24 (reduction rolls 24) are disposed such that the roll spacing between opposing rolls is gradually reduced toward the downstream end with respect to the casting direction. With the plurality of pairs of strand support rolls 24, the strand 14 can be reduction-rolled at a predetermined amount of reduction while the strand 14 is withdrawn downwardly in the casting direction. The group of rolls made up of the plurality of pairs of strand support rolls 24 is also referred to as a "soft-reduction zone".

The static magnetic field generation devices 20 and 22 are, for example, DC magnetic field application coils and are provided in a segment corresponding to a region where a solid fraction fs at a thickness-wise middle position of the strand 14 is 0.24 to 0.30. The static magnetic field generation devices 20 and 22 apply a static magnetic field to the unsolidified layer 16, which is within the strand 14. The magnetic field is in a direction orthogonal to the direction in which the strand 14 is withdrawn. The static magnetic field applied by the static magnetic field generation devices 20 and 22 inhibits a flow that occurs in the unsolidified layer 16 in a direction orthogonal to the direction in which the strand is withdrawn. That is, a low-temperature portion of the unsolidified layer 16, which is adjacent to the solidified shell, is inhibited from mixing with a high-temperature portion of the unsolidified layer 16, which is adjacent to the thickness-wise middle. In other words, thermal convection in the unsolidified layer 16 is inhibited, and as a result, the temperature gradient of the unsolidified layer 16 in the direction orthogonal to the direction in which the strand is withdrawn increases. The reason that the flow in the unsolidified layer 16 is inhibited by a static magnetic field is that when molten steel is to move in a space in which an applied static magnetic field is present, a braking force due to the static magnetic field acts in a direction opposite to the direction in which the molten steel moves.

As a result of the increase in the temperature gradient of the unsolidified layer 16, formation of equiaxed crystals in a thickness-wise middle portion of the strand 14 is inhibited, and consequently, the solidified structure of the strand 14 in the thickness direction is a columnar-crystallized structure, and the solidified structure of the thickness-wise middle portion of the strand 14 is a columnar-crystallized structure. Since the solidified structure of the thickness-wise middle portion of the strand 14 is a columnar-crystallized structure, the solidification interface is uniform, and therefore, formation of large voids is inhibited in the final stage of solidification. Consequently, the strand 14, which is continuously cast in the continuous casting machine 10, has reduced centerline segregation.

The static magnetic field generation devices 20 and 22 may be installed at positions corresponding to a region where the solid fraction fs at the thickness-wise middle position of the strand 14 is greater than 0 and 0.3 or less, in a manner such that a static magnetic field in a direction orthogonal to the direction in which the strand 14 is withdrawn can be applied. Thermal convection in the unsolidified layer 16 occurs when the solid fraction fs at the thickness-wise middle position of the strand 14 is low and therefore the flowability of the unsolidified layer 16 is high, whereas no thermal convection occurs in the unsolidified layer 16 when the solid fraction fs at the thickness-wise middle position of the strand 14 is high and therefore the flowability of the unsolidified layer 16 is low. Accordingly, by applying a static magnetic field at a position corresponding to a region where the solid fraction fs at the thickness-wise middle position of the strand 14 is greater than 0 and 0.3 or less, thermal convection in the unsolidified layer 16 can be inhibited effectively. As a result, an average segregation spot diameter of the solidified structure of the thickness-wise middle portion of the strand 14 can be reduced.

Note that the solid fraction fs at the thickness-wise middle position of the strand 14 is a solid fraction at a midpoint of a cross section in a direction perpendicular to the direction in which the strand 14 is withdrawn. The solid fraction fs at the thickness-wise middle position of the strand 14 can be calculated from the temperature of the molten steel at the midpoint of a cross section in a direction perpendicular to the direction in which the strand 14 is withdrawn (hereinafter also simply referred to as the "midpoint of the strand"). Specifically, a solid fraction difference and a temperature difference may be determined by using the temperature of molten steel at which the solid fraction is 0 and the temperature of the molten steel at which the solid fraction is 1.0. Based on the correspondence relationship between the solid fraction difference and the temperature difference, a formula representing a relationship between the temperature of the molten steel and the solid fraction can be calculated. Accordingly, when the temperature of the molten steel at the midpoint of the strand 14 can be calculated, the solid fraction corresponding to the temperature of the molten steel can be calculated.

Furthermore, the temperature at the midpoint of the strand 14 can be calculated by using the surface temperature of the solidified shell 18 and a heat transfer equation described in Publication 1 ("Heat Transfer Experiment in Continuous Billet Heating Furnace and Calculation Method", issued by The Iron and Steel Institute of Japan on May 10, 1971). A thermocouple may be provided at the solidified shell 18, and temperature changes in the surface temperature of the solidified shell 18 may be obtained. Accordingly, a temperature profile of the surface of the solidified shell in the strand withdrawal direction can be obtained. By using the obtained temperature profile of the surface of the solidified shell 18 and the heat transfer equation, a temperature profile of the midpoint of the strand 14 in the withdrawal direction is calculated.

By using the temperature profile of the midpoint of the strand 14 and the pre-calculated formula representing a relationship between the temperature of the molten steel and the solid fraction, a profile of the solid fraction fs at the thickness-wise middle position of the strand in the direction in which the strand 14 is withdrawn is calculated. Based on the calculated profile of the solid fraction fs at the thickness-wise middle position of the strand 14, the positions in the continuous casting machine 10 at which the static magnetic field generation devices 20 and 22 are to be installed are set.

The strength of the magnetic field to be applied to the strand 14 is greater than or equal to 0.15 T. If the strength of the magnetic field to be applied is less than 0.15 T, the average segregation spot diameter of the thickness-wise middle portion of the strand 14 cannot be reduced, and therefore centerline segregation in the strand 14 cannot be inhibited.

Furthermore, an application time ratio is greater than or equal to 10%. The application time ratio is a ratio for applying a static magnetic field having a magnetic field strength of greater than or equal to 0.15 T to the strand 14. If the application time ratio is less than 10%, the solidified structure of the thickness-wise middle portion of the strand 14 cannot be a columnar crystal structure, and therefore centerline segregation in the strand 14 cannot be inhibited.

Note that the application time ratio is a value calculated according to formula (2) below.

[Math. 3]

$$\text{Application time ratio (\%)} = \frac{\left(\begin{array}{c}\text{Time period during which static magnetic field is}\\ \text{applied to strand (min)}\end{array}\right)}{\left(\begin{array}{c}\text{Time period from time at which solid fraction}\\ \text{at thickness-wise middle position of strand}\\ \text{exceeds 0 to time at which solid fraction}\\ \text{reaches 0.3 (min)}\end{array}\right)} \times 100 \quad (2)$$

Furthermore, it is preferable to control the temperature gradient and the solidification rate of the strand 14 to ensure that the solidified structure is a uniform columnar crystal structure so that centerline segregation in the strand 14 can be further inhibited. Here, a temperature gradient G is defined as a temperature gradient (° C./mm) at a position where the solid fraction of the strand 14 is 0.99 in a region where the solid fraction at the thickness-wise middle position is 0.3. Furthermore, a solidification rate V is defined as a speed (mm/min) at which the solid-liquid interface of the strand 14 moves.

According to this definition, the strand 14 is preferably as follows when the solid fraction fs at the thickness-wise middle position of the strand 14 is 0.3: the value determined by formula (3) below, which includes the temperature gradient G and the solidification rate V, is greater than or equal to 0.27° C.×min$^{1/2}$/mm$^{3/2}$. As a result, the solidified structure of the thickness-wise middle portion of the strand 14 is a uniform columnar crystal structure, and consequently, in the strand 14, which is continuously cast in the continuous casting machine 10, centerline segregation is further inhibited.

[Math. 4]

$$\frac{G}{\sqrt{V}} \quad (3)$$

On the other hand, if the value determined by formula (3) is smaller than 0.27° C.×min$^{1/2}$/mm$^{3/2}$, the solidified structure of the thickness-wise middle portion of the strand 14 cannot be a uniform columnar crystal structure, that is, the above-described effect is not produced.

To check for centerline segregation in the strand 14, a sample may be cut from the thickness-wise middle portion of the strand 14 and evaluated. The sample may be 50 mm in thickness, 410 mm in width, and 80 mm in length, for example. Specifically, a cross section parallel to the casting direction of the cut sample is etched with saturated picric acid, thereby revealing the macrostructure, and photographs of macrosegregation spots and semi-macrosegregation spots observed in the thickness-wise middle region of the strand 14 are taken. The macrosegregation spots have a segregation spot diameter of approximately 5 mm, and the semi-macrosegregation spots have a segregation spot diameter of approximately 1 mm. Next, the photographs taken are subjected to image analysis to measure the average area of the segregation spots, and an average circle-equivalent spot diameter (average segregation spot diameter) is calculated from the average area. Based on the calculated average spot diameter, the size of the segregation spots can be evaluated.

Segregation spots are formed in the final solidification portion in the thickness-direction middle region as the solidification of the unsolidified layer 16 progresses. The final solidification portion is a portion where columnar crystals grown from the upper-surface side (side opposite to the reference plane of the continuous casting machine) of the strand 14 and columnar crystals grown from the lower-surface side (side corresponding to the reference plane of the continuous casting machine) of the strand 14 collide with each other. It is known that the greater the centerline segregation, the greater the size (segregation spot diameter) of the segregation spots, and that as the size increases, workability and the like decrease. That is, reducing the segregation spot diameter means reducing centerline segregation. Accordingly, centerline segregation in the strand 14 can be evaluated by measuring the segregation spot diameter.

In the case where the solidified structure of the thickness-wise middle portion of the strand 14 is formed to be a columnar crystal structure by using the above-described method, the following may occur. In regions where dendrites come into contact with each other at both the solidification interfaces, small voids may be formed at the end portions of dendrites, and the small voids may remain and form small porosities in the strand 14. It is preferable that, to prevent the formation of small voids, reduction rolling at a reduction ratio in a range of 5.0% or less (hereinafter also referred to as "soft reduction") be performed on the strand 14 by using the plurality of pairs of strand support rolls 24, the reduction rolling being performed over a range in which the solid fraction fs at the thickness-wise middle position of the strand 14 ranges from 0.3 to 0.7. When the solidified shell 18 of the strand 14 in the final stage of solidification is forcibly reduction-rolled, small voids, described above, easily disappear. Furthermore, since the strand 14 in the final stage of solidification is reduction-rolled, the flow of enriched molten steel is inhibited, and therefore centerline segregation in the strand 14 is mitigated.

As used herein, the "reduction ratio" refers to the amount of reduction in thickness from the thickness of the strand 14 prior to reduction rolling (difference between the thickness of the strand 14 prior to reduction rolling and the thickness of the strand 14 after reduction rolling), expressed as a ratio (percentage). When the reduction ratio is greater than 5.0%, internal cracks form in the strand 14 because the amount of reduction is excessively large. On the other hand, if the reduction ratio is excessively low, porosities remain in the thickness-wise middle portion of the strand 14. Accordingly, it is desirable that an amount of reduction of approximately 1.0% be ensured.

If reduction rolling is started after the solid fraction at the thickness-wise middle position of the strand 14 exceeds 0.3, there is a possibility that centerline segregation in the strand 14 cannot be inhibited because the flow of enriched molten steel may have already begun. Furthermore, in a range in which the solid fraction at the thickness-wise middle position of the strand 14 is greater than 0.7, the flow of enriched molten steel does not occur, and therefore, centerline segregation does not deteriorate even when no reduction rolling is performed. Accordingly, it is necessary to perform soft reduction over a range in which the solid fraction fs at the thickness-wise middle position of the strand 14 ranges from 0.3 to 0.7.

Furthermore, if the reduction rolling speed is less than 0.30 mm/min, the reduction rolling speed is too low relative to the amount of solidification shrinkage, and therefore the flow of enriched molten steel is not sufficiently inhibited. On the other hand, if the reduction rolling speed is greater than 2.00 mm/min, the reduction rolling speed is too high relative to the amount of solidification shrinkage, and therefore inverted V segregation and/or internal cracking may occur. Accordingly, when soft reduction is performed, it is desirable that the reduction rolling speed be in the range of 0.30 to 2.00 mm/min.

In the case where soft reduction is performed on the strand 14 in the final stage of solidification, the strand 14, which is continuously cast in the continuous casting machine 10, has further reduced centerline segregation and porosities because of the segregation reducing effect, which is produced by the application of a static magnetic field, and the segregation mitigation effect and the porosity prevention effect, which are produced by the soft reduction.

As described above, in accordance with aspects of the present invention, a static magnetic field is applied to a region of a strand 14, the region being a region where the solid fraction at a thickness-wise middle position of the strand 14 is in a range of greater than 0 and 0.3 or less, the static magnetic field being applied in a direction orthogonal to the strand withdrawal direction at a predetermined strength for a predetermined length of time. Thus, thermal convection in the unsolidified layer 16 within the strand is inhibited, which increases the temperature gradient of the unsolidified layer 16 in a thickness direction of the strand 14. Consequently, the solidified structure of the thickness-wise middle portion of the strand 14 is a columnar crystal structure. As a result, the average segregation spot diameter of the thickness-wise middle portion of the strand is reduced, and therefore, the following is achieved: the strand 14, which is cast using a continuous casting machine, has reduced centerline segregation of solute elements, such as carbon, phosphorus, sulfur, and manganese.

EXAMPLES

A strand was continuously cast by using a bloom continuous casting machine, which has the same configuration as the continuous casting machine illustrated in FIG. 1 and in which the line length of the continuous casting machine is 19.9 m and the radius of curvature thereof is 15 m. With the continuous casting machine, strands having a thickness of 250 mm and a width of 410 mm in terms of cross-sectional size can be cast. The components of the molten steel poured into the mold included the following: carbon, 0.7 mass %; silicon, 0.2 mass %; and manganese, 0.9 mass %. The strand withdrawal speed was 0.8 m/min, and the degree of superheat of molten steel (temperature of molten steel−liquidus temperature) in the tundish was 20° C.

Static magnetic field generation devices were installed at positions corresponding to a region where the solid fraction fs at the thickness-wise middle position of the strand is 0.24 to 0.30. Continuous casting was performed at various application time ratios and at various magnetic field strengths, the application time ratio being defined by formula (2). The application time ratios were 2%, 5%, 8%, 10%, 15%, and 20%, and the magnetic field strengths were 0.05 T, 0.10 T, 0.15 T, 0.20 T, and 0.30 T.

Table 1 shows the solidified structure and the measured average segregation spot diameter of the thickness-wise middle portion of each of the strands. With regard to the solidified structure of the thickness-wise middle portion of the strand, the type of solidified structure was determined as described above. That is, a cross section of a sample cut from the strand was etched with saturated picric acid, thereby revealing the macrostructure, and the structure was visually examined. Furthermore, the average segregation spot diameter was also determined as described above. That is, the average area of the segregation spots was measured, and an average circle-equivalent spot diameter was calculated from the average area and was designated as the average segregation spot diameter.

TABLE 1

| Magnetic field (T) | Application time ratio (%) | Solidified structure of thickness-wise middle portion of strand | Average segregation spot diameter (mm) |
|---|---|---|---|
| 0 | 0 | Equiaxed crystal | 10.0 |
| 0.05 | 2 | Equiaxed crystal | 10.2 |
| 0.05 | 5 | Equiaxed crystal | 10.0 |
| 0.05 | 8 | Equiaxed crystal | 9.4 |
| 0.05 | 10 | Columnar crystal | 9.4 |
| 0.05 | 15 | Columnar crystal | 9.1 |
| 0.05 | 20 | Columnar crystal | 9.0 |
| 0.10 | 2 | Equiaxed crystal | 10.2 |
| 0.10 | 5 | Equiaxed crystal | 9.9 |
| 0.10 | 8 | Equiaxed crystal | 9.4 |
| 0.10 | 10 | Columnar crystal | 9.2 |
| 0.10 | 15 | Columnar crystal | 9.3 |
| 0.10 | 20 | Columnar crystal | 8.8 |
| 0.15 | 2 | Equiaxed crystal | 10.2 |
| 0.15 | 5 | Equiaxed crystal | 10.0 |
| 0.15 | 8 | Equiaxed crystal | 8.8 |
| 0.15 | 10 | Columnar crystal | 2.2 |
| 0.15 | 15 | Columnar crystal | 1.4 |
| 0.15 | 20 | Columnar crystal | 1.1 |
| 0.20 | 2 | Equiaxed crystal | 10.2 |
| 0.20 | 5 | Equiaxed crystal | 9.7 |
| 0.20 | 8 | Equiaxed crystal | 7.7 |
| 0.20 | 10 | Columnar crystal | 1.6 |
| 0.20 | 15 | Columnar crystal | 1.2 |
| 0.20 | 20 | Columnar crystal | 0.9 |
| 0.30 | 2 | Equiaxed crystal | 10.2 |
| 0.30 | 5 | Equiaxed crystal | 9.5 |
| 0.30 | 8 | Equiaxed crystal | 8.1 |
| 0.30 | 10 | Columnar crystal | 1.4 |
| 0.30 | 15 | Columnar crystal | 0.9 |
| 0.30 | 20 | Columnar crystal | 0.8 |

Figure 2:
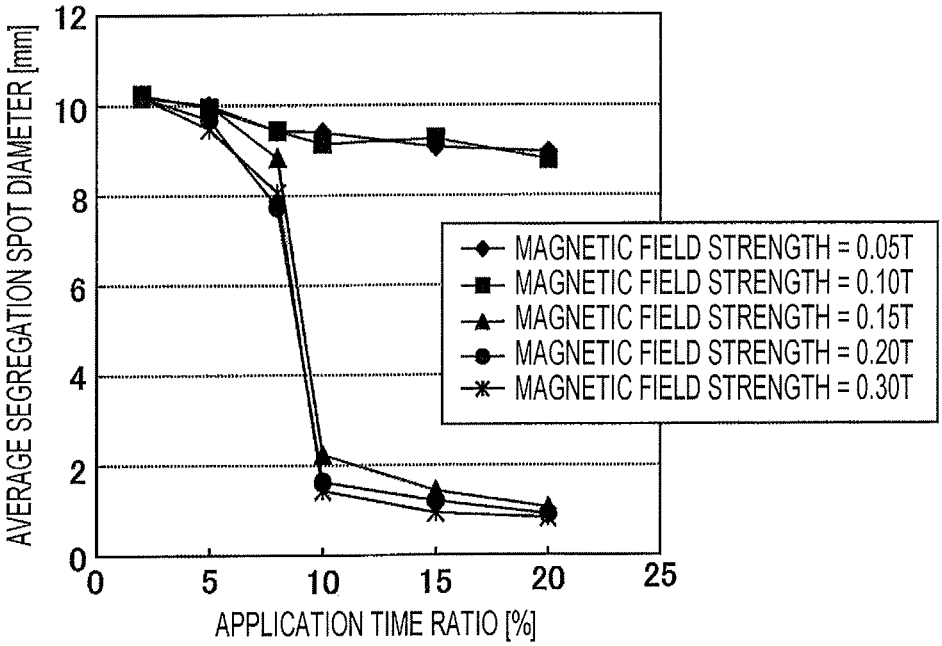
FIG. 2 is a graph illustrating a relationship between an average segregation spot diameter and an application time ratio. In the graph, the relationships corresponding to different magnetic field strengths are compared.
Figure 3:
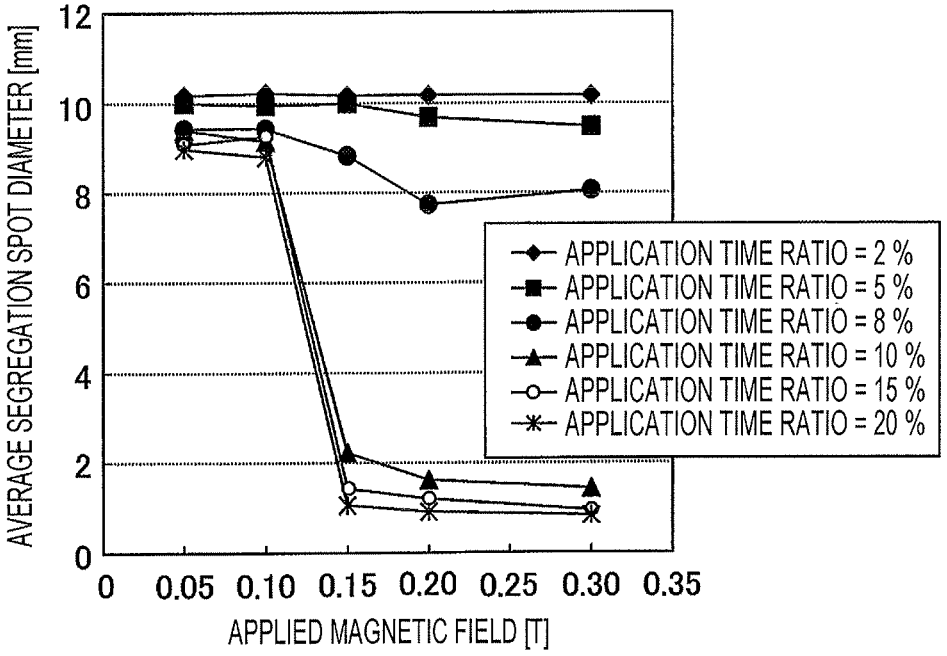
FIG. 3 is a graph illustrating a relationship between the average segregation spot diameter and the magnetic field strength. In the graph, the relationships corresponding to different application time ratios are compared.

FIG. 2 is a graph illustrating a relationship between the average segregation spot diameter and the application time ratio for each of different magnetic field strengths, based on the measurement results shown in Table 1. FIG. 3 is a graph illustrating a relationship between the average segregation spot diameter and the magnetic field strength for each of different application time ratios, based on the measurement results shown in Table 1.

From FIG. 2, it is seen that in the case where the magnetic field strength is less than or equal to 0.10 T, the average segregation spot diameter does not change significantly even when the application time ratio is increased. In contrast, it is seen that in the case where the magnetic field strength is greater than or equal to 0.15 T, the average segregation spot diameter can be reduced by setting the application time ratio to greater than or equal to 10%.

From FIG. 3, it is seen that in the case where the application time ratio is less than or equal to 8%, the average segregation spot diameter does not change significantly even when the magnetic field strength is increased. In contrast, it is seen that in the case where the application time ratio is greater than or equal to 10%, the average segregation spot diameter can be reduced by setting the magnetic field strength to greater than or equal to 0.15 T.

Furthermore, Table 1 confirms that in the case where the magnetic field strength is greater than or equal to 0.15 T, the solidified structure of the middle region of the strand can be a columnar crystal structure when the application time ratio is set to be greater than or equal to 10%.

These results demonstrate the following. When continuous casting is performed with application of a static magnetic field to a strand, the solidified structure of the thickness-wise middle portion of the strand can be a columnar structure, and therefore, the average segregation spot diameter of the solidified structure of the thickness-wise middle portion of the strand can be reduced, that is, centerline segregation in the strand can be mitigated. The static magnetic field is applied at an application time ratio of 10% and at a magnetic field strength of 0.15 T or greater by using a static magnetic field generation device provided in a continuous casting machine. The static magnetic field generation device is provided at at least a portion of a region corresponding to a range in which the solid fraction fs at the thickness-wise middle position of the strand is greater than 0 and 0.3 or less.

Furthermore, a test was conducted using the continuous casting machine mentioned above. In the test, while a static magnetic field was applied to the strand, reduction rolling (soft reduction) was performed on the strand in a gradual manner in the final stage of solidification by using a plurality of pairs of strand support rolls disposed such that the spacing between rolls is gradually reduced toward the downstream end with respect to the casting direction. This test was conducted to investigate whether reduction rolling performed on a strand in the final stage of solidification has any influence on the solidified structure of the thickness-wise middle portion of the strand.

The conditions for the reduction rolling of the strand were as follows. The reduction rolling speed was within a range of 0.30 to 2.00 mm/min. The reduction ratio was varied: 0%, 0.1%, 0.8%, 1.0%, 5.0%, 7.0%, and 10.0%. The reduction rolling was performed over a range in which the solid fraction at the thickness-wise middle position of the strand was 0.3 or greater and 0.7 or less. During the reduction rolling, a static magnetic field having a magnetic field strength of 0.15 T was applied to the strand at an application time ratio of 10%, via the static magnetic field generation devices installed at positions corresponding to a region where the solid fraction fs at the thickness-wise middle position of the strand was 0.24 to 0.30.

Table 2 shows the results of an investigation regarding porosities in the thickness-wise middle portion of the strand under various reduction rolling conditions. In the investigation, a static magnetic field having a magnetic field strength of 0.15 T was applied at an application time ratio of 10%, thereby controlling the solidified structure to be a columnar crystal structure. The degree of porosities in the thickness-wise middle portion of the strand was evaluated by visually observing a cross section of the sample.

TABLE 2

| Magnetic field (T) | Application time ratio (%) | Reduction ratio (%) | Internal defects in thickness-wise middle portion of strand |
|---|---|---|---|
| 0.15 | 10 | 0 | Porosities remained |
| | | 0.1 | Porosities remained |
| | | 0.8 | Porosities remained |
| | | 1.0 | No porosities |
| | | 5.0 | No porosities |
| | | 7.0 | No porosities, but internal cracking occurred |

TABLE 2-continued

| Magnetic field (T) | Application time ratio (%) | Reduction ratio (%) | Internal defects in thickness-wise middle portion of strand |
|---|---|---|---|
| | | 10.0 | No porosities, but internal cracking occurred |

As shown in Table 2, it was found that a strand in which no porosities are formed can be produced by, after application of a static magnetic field, performing reduction rolling on a region of the strand, the region being a region where the solid fraction at the thickness-wise middle position ranges from 0.3 to 0.7, at a reduction ratio within a range of 1.0% to 5.0%. In the case where the reduction ratio was less than 1.0%, porosities remained because the amount of reduction was insufficient, whereas, in the case where the amount of reduction was greater than 5.0%, the formation of porosities was inhibited, but internal cracking occurred in the strand.

It is preferable that the temperature gradient and the solidification rate be controlled to ensure that the solidified structure is a columnar crystal structure. Specifically, in the case where the temperature gradient is small, the solidification rate may be reduced, and, in the case where the temperature gradient is large, the solidification rate may be increased. As a result, it is predicted that a uniform columnar crystal structure will form. Accordingly, a test was conducted in which the relationship between the temperature gradient G and the solidification rate V was investigated using a water-cooled mold for testing. The test was conducted in the following manner. Molten steel was poured into the water-cooled mold for testing to fill the interior space of the water-cooled mold with the molten steel. Only the long-side surfaces of the water-cooled mold were water-cooled to cool the molten steel. A static magnetic field was applied when the solid fraction fs at the thickness-wise middle position of the strand was 0.3 via a static magnetic field generation device installed at a back surface of the water-cooled mold.

It is to be noted that, as described above, the temperature gradient G is a temperature gradient (° C./mm) at a position where the solid fraction of the strand is 0.99 at a point in time when the solid fraction at the thickness-wise middle position is 0.3. Furthermore, the solidification rate V is a speed (mm/min) at which the solid-liquid interface of the strand moves.

Two R-type thermocouples were provided on the strand in the water-cooled mold (at a position ½ the long-side width and ½ the short-side thickness and at a position ½ the long-side width and ¼ the short-side thickness). A temperature profile in a direction toward a middle of the strand was obtained from the temperature data output from the thermocouples and a heat transfer equation. Subsequently, the temperature gradient G (° C./mm) at the position where the solid fraction is 0.99 was calculated from the obtained temperature profile. Specifically, the temperature gradient G was calculated by using temperatures at positions forward and rearward of the position where the solid fraction is 0.99, as calculated from the temperature profile, and the distance between the forward position and the rearward position.

The position of the solid-liquid interface of the strand was calculated from the temperature profile of the strand, which was calculated from the temperature data output from the thermocouples and the heat transfer equation. The speed V (mm/min) at which the solid-liquid interface of the strand moves was calculated by using the amount of change per unit time of the temperature profile.

Table 3 shows the results of an investigation of the relationship between the temperature gradient G and the solidification rate V. Table 3 shows that in the case where the value determined by formula (3) was smaller than 0.19° C.×min$^{1/2}$/mm$^{3/2}$, an equiaxed crystal structure in which the dendrite growth direction was non-uniform was observed in the thickness-wise middle portion of the strand. On the other hand, it was observed that in the case where the value determined by formula (3) was greater than or equal to 0.19° C.×min$^{1/2}$/mm$^{3/2}$, a columnar crystal structure was formed, and in the case where the value determined by formula (3) was greater than or equal to 0.27° C.×min$^{1/2}$/mm$^{3/2}$, a uniform columnar crystal structure was formed.

TABLE 3

| Magnetic field (T) | Application time ratio (%) | Solidified structure of thickness-wise middle portion of strand | $\frac{G}{\sqrt{V}}$ (° C.×min$^{1/2}$/mm$^{3/2}$) |
|---|---|---|---|
| 0 | 0 | Equiaxed crystal | 0.10 |
| 0.10 | 5 | Equiaxed crystal | 0.12 |
| 0.10 | 10 | Highly non-uniform structure | 0.19 |
| 0.15 | 5 | Equiaxed crystal | 0.14 |
| 0.15 | 10 | Uniform columnar crystal structure | 0.27 |
| 0.20 | 5 | Equiaxed crystal | 0.16 |
| 0.20 | 10 | Uniform columnar crystal structure | 0.30 |

Table 3 confirms that when the temperature gradient G and the solidification rate V are controlled in a manner such that the value determined by formula (3) is greater than or equal to 0.27° C.×min$^{1/2}$/mm$^{3/2}$, the average segregation spot diameter of the solidified structure of the thickness-wise middle portion of the strand can be reduced, and consequently, the solidified structure of the thickness-wise middle portion of the strand can be an even more uniform columnar crystal structure. Accordingly, it is found that centerline segregation in a strand that is cast in a continuous casting machine can be further reduced.

REFERENCE SIGNS LIST

10 Continuous casting machine
12 Mold
14 Strand
16 Unsolidified layer
18 Solidified shell
20 Static magnetic field generation device
22 Static magnetic field generation device
24 Reduction roll

The invention claimed is:

1. A continuous steel casting method, the method including producing a strand, the producing of the strand including pouring molten steel into a mold of a continuous casting machine and withdrawing a solidified shell from the mold, the solidified shell being a solidified portion of the molten steel, the method comprising applying a static magnetic field to at least a portion of a region of the strand, the strand being in the continuous casting machine, the region being a region where a solid fraction fs at a thickness-wise middle position of the strand is in a range of formula (1) below, the static magnetic field having a magnetic field strength of greater than or equal to 0.15 T and being in a direction orthogonal to a direction in which the strand is withdrawn, the static magnetic field being applied at an application time ratio of greater than or equal to 10%, the application time ratio being defined by formula (2) below.

$$0 < fs \leq 0.3 \quad (1)$$

$$\text{Application time ratio (\%)} = \frac{\left(\begin{array}{c}\text{Time period during which static magnetic field is}\\ \text{applied to strand (min)}\end{array}\right)}{\left(\begin{array}{c}\text{Time period from time at which solid fraction}\\ \text{at thickness-wise middle position of strand}\\ \text{exceeds 0 to time at which solid fraction}\\ \text{reaches 0.3 (min)}\end{array}\right)} \times 100 \quad (2)$$

2. The continuous steel casting method according to claim 1, wherein, in a region where the solid fraction at the thickness-wise middle position of the strand is 0.3, a value determined by formula (3) below is greater than or equal to 0.27° C.×min$^{1/2}$/mm$^{3/2}$, $$\frac{G}{\sqrt{V}} \quad (3)$$

where G is a temperature gradient (° C./mm) at a position where a solid fraction of the strand is 0.99 in a region where the solid fraction at the thickness-wise middle position is 0.3, and V is a speed (mm/min) at which a solid-liquid interface of the strand moves.

3. The continuous steel casting method according to claim 1, further comprising performing reduction rolling on a region of the strand, the region being a region where the solid fraction at the thickness-wise middle position of the strand ranges from 0.3 to 0.7, the reduction rolling being performed by using a plurality of pairs of strand support rolls disposed such that a spacing between rolls is gradually reduced toward a downstream end with respect to a casting direction, the reduction rolling being performed at a reduction ratio of less than or equal to 5.0%.

4. The continuous steel casting method according to claim 1, wherein, at a point in time when the solid fraction at the thickness-wise middle position of the strand is 0.3, a value determined by formula (3) below is greater than or equal to 0.27° C.×min$^{1/2}$/mm$^{3/2}$, $$\frac{G}{\sqrt{V}} \quad (3)$$

where G is a temperature gradient (° C./mm) at a position where a solid fraction of the strand is 0.99 at the point in time when the solid fraction at the thickness-wise middle position is 0.3, and V is a speed (mm/min) at which a solid-liquid interface of the strand moves, further comprising performing reduction rolling on a region of the strand, the region being a region where the solid fraction at the thickness-wise middle position of the strand ranges from 0.3 to 0.7, the reduction rolling being performed by using a plurality of pairs of strand support rolls disposed such that a spacing between rolls is gradually reduced toward a downstream end with respect to a casting direction, the reduction rolling being performed at a reduction ratio of less than or equal to 5.0%.

* * * * *